United States Patent [19]

Daniels

[11] 4,267,588

[45] May 12, 1981

[54] HOURGLASS CONSTRUCTION

[76] Inventor: Alexander Daniels, 56 Oxcycocus Rd., Manahawkin, N.J. 08050

[21] Appl. No.: 967,298

[22] Filed: Dec. 7, 1978

[51] Int. Cl.[3] ..... G04F 1/04

[52] U.S. Cl. ..... 368/93

[58] Field of Search ..... 58/144; D10/44; 368/93, 368/95

[56] References Cited

U.S. PATENT DOCUMENTS 372,090 10/1887 Shaw ..... 58/144

2,625,003 1/1953 Burden ..... 58/144

3,125,849 3/1964 Wachtel ..... 58/144

FOREIGN PATENT DOCUMENTS 2361308 6/1974 Fed. Rep. of Germany ..... 58/144

*Primary Examiner*—Vit W. Miska

*Attorney, Agent, or Firm*—Robert K. Youtie

[57] ABSTRACT

An hourglass construction comprising a pair of containers arranged with their mouths together and provided with a through passageway for fluent material.

1 Claim, 6 Drawing Figures

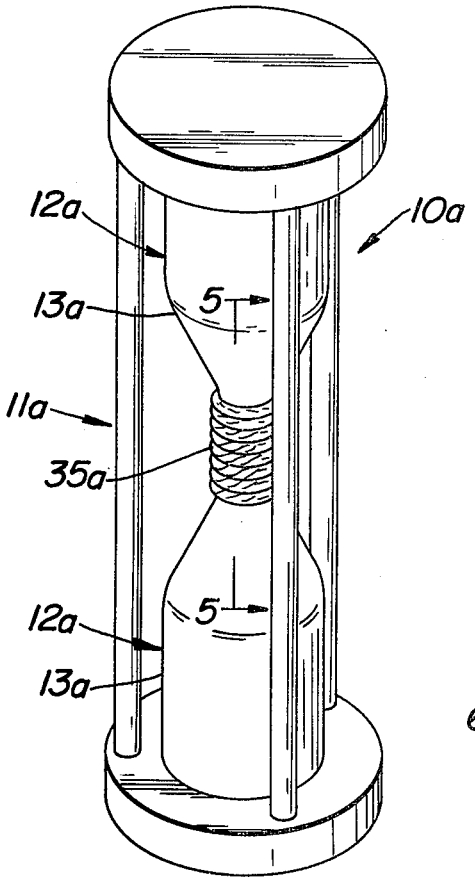
FIG. 4
FIG. 5
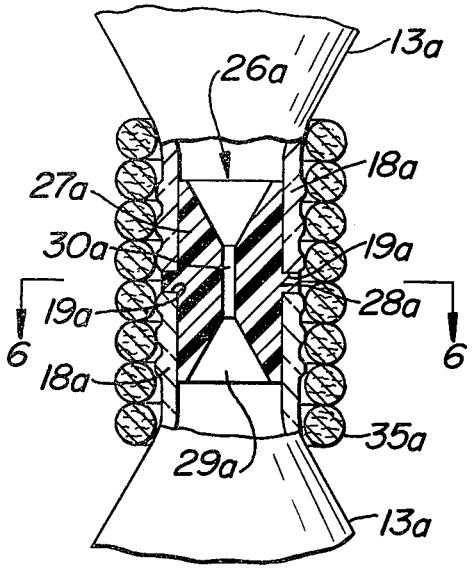
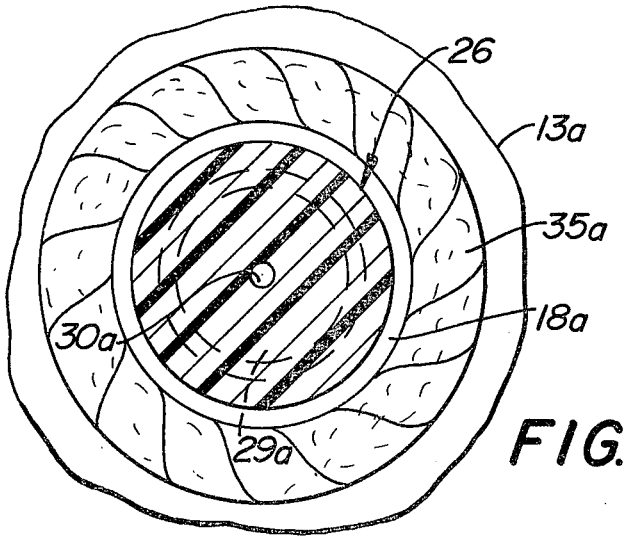
FIG. 6

HOURGLASS CONSTRUCTION

BACKGROUND OF THE INVENTION

While there have, in the past, been proposed a great number of hourglass constructions, these have not been manufactured in a manner to permit of utilizing conventional containers in a unique manner capable of strong advertising value.

SUMMARY OF THE INVENTION

Accordingly, it is an important object of the present invention to provide an hourglass construction which overcomes the above mentioned difficulties, is extremely simple in construction for ease and economy in manufacture, capable of being substantially completely manufactured from extremely inexpensive and even waste materials, is well adapted to provide a uniquely attractive and attention arresting advertising device, and which is further capable of timing beverage consumption and inducing repeated beverage consumption.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 4 is a perspective view showing a slightly modified hourglass construction in accordance with the teachings of the present invention.

FIG. 5 is a partial longitudinal sectional view taken generally along the line 5—5 of FIG. 4, enlarged for clarity.

FIG. 6 is a transverse sectional view taken generally along the line 6—6 of FIG. 5.

DESCRIPTION OF THE PREFERRED EMBODIMENT

Figure 1:
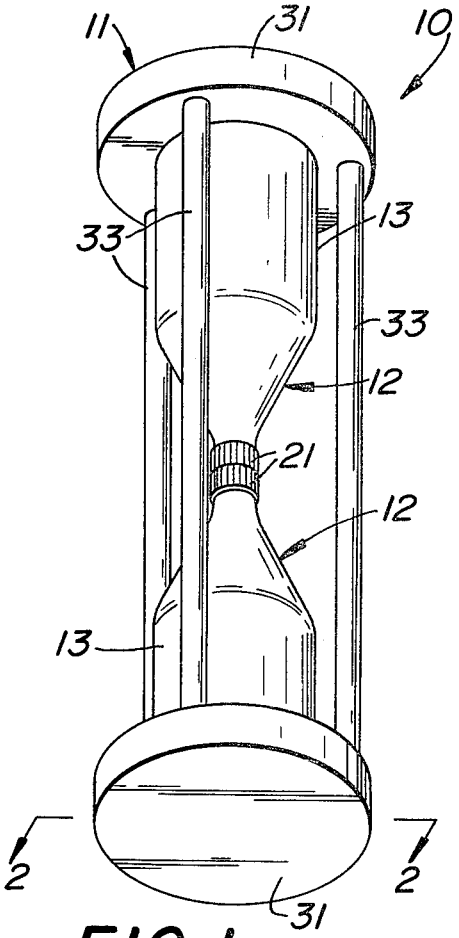
FIG. 1 is an end perspective view showing an hourglass construction of the present invention.
Figure 2:
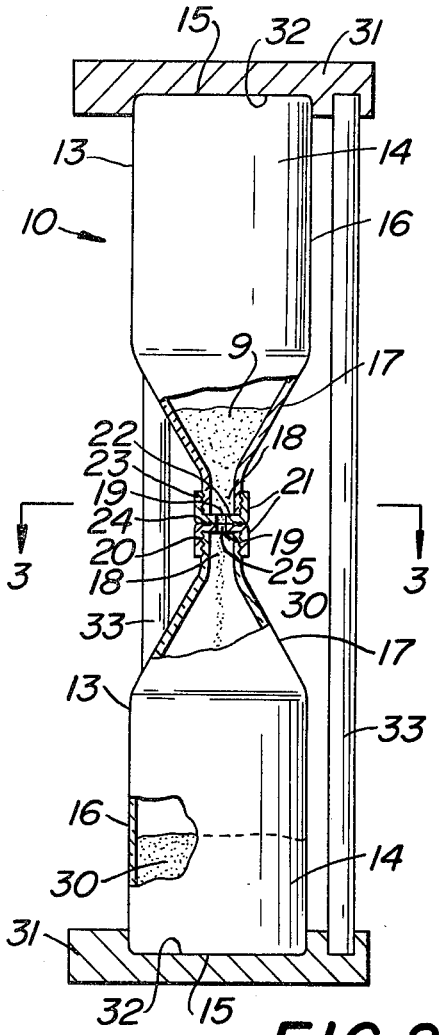
FIG. 2 is a longitudinal sectional view taken generally along the line 2—2 of FIG. 1, and partly broken away for clarity of understanding.
Figure 3:
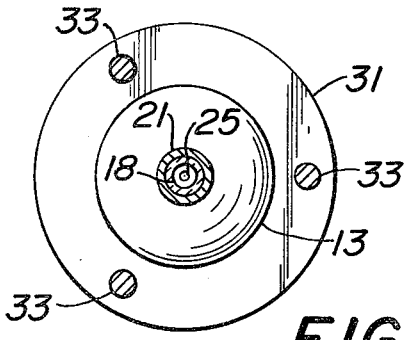
FIG. 3 is a transverse sectional view taken generally along the line 3—3 of FIG. 2.

Referring now more particularly to the drawings, and specifically to FIGS. 1 and 2 thereof, an hourglass construction is there generally designated 10, and may include an outer, open framework 11, within which are a pair of light permeable containers, each designated 12, joined together in fluid communication for passing fluent material 9 between the containers.

More specifically, the containers 12 may each advantageously consist of a bottle, jar, or beverage container, as at 13, say of the type conventionally employed for distributing beverages, such as beer, soda, or other. The containers or bottles 13 may be substantially identical, and, at least to some degree, light permeable, say being fabricated of light permeable glass or plastic. Each container or vessel 13 may include a major part of body 14 having a lower end or bottom wall 15 from which upstands a circumferential or side wall 16. The side wall 16 may extend away from the bottom wall 15 into mergence with a convergent or tapering wall portion 17 which, in turn, merges with a reduced tubular end portion or neck 18. The neck terminates in an open end or mouth 19.

While both containers or vessels 12 are illustrated and described as being substantially identical, it is appreciated that this is not essential to the practice of the present invention.

The bottle necks or reduced end portions 18 may be suitably formed to receive closures or caps, such as with a bead or lip for a crown or crimped cap, or with external threads for an internally threaded cap or closure, as illustrated, or otherwise. That is, the bottle necks 18 may be externally threaded, as at 20 for releasable retaining engagement with an appropriate closure or cap 21. The caps 21 may be substantially identical, each including a generally circular top or end wall 22 extending over the respective bottle mouth 19, and a circumferential side wall or skirt 23 circumscribing the adjacent neck 18, say having internal screwthreads for threaded engagement with the neck.

It will be apparent that the containers or vessels are arranged in end-to-end opposed aligned relation with the closures or caps 20 in proximate or contiguous relation with each other.

Further, the caps or closures 20 may have their top or end walls 22 in facing engagement with each other, and secured together by suitable securing means, such as welding, solder, or the like, as indicated at 24. Thus, the closures or caps 20 are suitably secured together to maintain the vessels or containers 12 in their opposed aligned relation.

Centrally of the adjacent cap end walls 22, there are provided apertures or openings 25. The apertures or openings 25 of the closures 20 are in aligned or registering relation with each other and combine to define a conduit or passageway communicating through the cap end walls 22 between the interiors of the pair of containers or vessels 12.

The aligned passageway defining openings 25, 25 are of sufficient size to pass fluent material of the type shown at 9 which may gravitationally flow from an upper container 12 through passageway 25, 25 to a lower container 12 in a predetermined period of time.

The open framework or cage 11 encompasses or contains the assembly of vessels 12 while affording ample visual access to the latter. Further, the framework 11 effectively protects the vessels 12 while serving to stably maintain the vessels in an upright orientation with either vessel uppermost, as desired.

In particular, the framework 11 may include a pair of generally flat or disc-like end pieces 31 each proximate to the bottom wall 15 of a respective bottle 13. Each end piece or disc member 31 may have one side generally centrally recessed, as at 32, for conformably receiving the respective container end wall 15 and adjacent container region.

Further, elongate connecting rods or tie members 33 may be arranged at spaced locations about the assembled containers 12, 12 and extend between the frame end pieces 31. That is, the tie members 33 may each extend between and have its opposite ends suitably connected to the end members 31. If desired, the tie members 33 may be detachably secured at their ends to the end members 31.

From the foregoing, it is believed that operation of the instant hourglass construction will be readily appreciated, as by standing the construction 10 on one end piece 31 until flow of the material 30 is completed to the lower vessel 12, after which the entire assembly may be inverted for repetition of the procedure.

It will now be appreciated that there is provided an hourglass construction which is extremely simple in structure, capable of fabrication from relatively common, inexpensive and easily acquired materials, and which is uniquely attractive as both a functional device as well as an article of decor. Its attractiveness as an advertisement of beverages is, of course, obvious.

Considering now the slightly modified embodiment of FIGS. 4–6, an hourglass construction is there generally designated 10*a*, including an open framework 11*a* within which are a pair of containers or bottles 12*a* joined together in fluid communication for passing fluent material between the containers.

The containers 12*a* may be identical and each consist of a bottle, jar or beverage container, as at 13*a* including a reduced tubular end portion or neck 18*a* terminating in an open end or mouth 19*a*. The bottle necks 18*a* may be externally threaded for retaining a cap, or otherwise configured, as desired.

With the bottles 13*a* arranged in generally longitudinally aligned or coaxial relation, their mouths 19*a* being in adjacent spaced location, a connector, nipple or fitting 26*a* is interposed between the bottle mouths 19*a* and extends into the bottle necks 18*a*, serving to define a closure in each bottle neck and provide a passageway communicating between the interiors of the containers 13*a*.

More specifically, the nipple, insert or connector 26*a* may include a generally cylindrical body 27*a* having its opposite ends extending through the mouths 19*a* of respective bottles 13*a* snugly into respective bottle necks 18*a*, and is provided with a longitudinally medial, circumferential external bead or shoulder 28*a* interposed in sandwiched relation between the bottle mouths 19*a*. Suitable adhesive means may be employed to effectively secure the nipple 26*a* in position within the bottle necks, if desired.

A through bore 29*a* may extend longitudinally and coaxially through nipple or insert 26*a*, defining a passageway communicating therethrough between the interiors of respective containers 13*a*. The bore 29*a* may have its opposite ends flaring outwardly, and have its longitudinally medial region 30*a* of reduced dimension for properly metering fluent material passing therethrough.

If desired, attractive ornamentation may be circumposed about the proximate bottle necks 18*a*, such as a wound rope or cord 35*a*.

It will now be appreciated that the modified embodiment of FIGS. 4–6 is also extremely simple in construction, requiring only the relatively simple insert or nipple 26*a*, which can be economically fabricated, as by injection molding, simple machining, or otherwise as desired.

Although the present invention has been described in some detail by way of illustration and example for purposes of clarity of understanding, it is understood that certain changes and modifications may be made within the spirit of the invention.

What is claimed is:

1. An hourglass construction comprising a pair of identical light permeable bottles each having an externally threaded mouth, a pair of identical threaded cap closures each having a circular flat top wall extending transversely across a respective bottle mouth and a skirt threadedly circumposed about the mouth of a respective bottle, said bottles being arranged in opposed aligned relation with said cap closures having their top walls in facing engagement with each other, securing means securing said cap closures in their engaging relation, a center hole in the top wall of each of said cap closures, said holes being in registry with each other and each axially aligned with and spaced inwardly of the mouth of the associated bottle to define an orifice communicating through said secured engaging cap top walls directly between the interiors of said bottles, and a fluent material contained in at least one of said bottles and flowable through said orifice into the other of said bottles.

* * * * *